US008624171B2

(12) United States Patent
Frey, Jr.

(10) Patent No.: US 8,624,171 B2
(45) Date of Patent: Jan. 7, 2014

(54) TAIL THRUSTER CONTROL FOR PROJECTILES

(75) Inventor: Robert D. Frey, Jr., Bolton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 13/319,777

(22) PCT Filed: Mar. 9, 2011

(86) PCT No.: PCT/US2011/027675

§ 371 (c)(1),
(2), (4) Date: Nov. 10, 2011

(87) PCT Pub. No.: WO2011/112668

PCT Pub. Date: Sep. 15, 2011

(65) Prior Publication Data

US 2012/0048991 A1 Mar. 1, 2012

Related U.S. Application Data

(60) Provisional application No. 61/312,281, filed on Mar. 10, 2010.

(51) Int. Cl.

| | |
|---|---|
| ***F42B 10/60*** | (2006.01) |
| ***F42B 10/66*** | (2006.01) |
| *F42B 10/00* | (2006.01) |

(52) U.S. Cl.

USPC ..... 244/3.22; 244/3.1; 244/3.15; 244/3.21; 244/3.24; 244/3.3

(58) Field of Classification Search

USPC ..... 244/3.1–3.3, 158.1, 164, 165, 169; 701/400, 408, 468

See application file for complete search history.

(56) References Cited

U.S. PATENT DOCUMENTS

| | | | | |
|---|---|---|---|---|
| 2,965,334 | A * | 12/1960 | McCullough, Jr. et al. | 244/3.22 |
| 3,027,117 | A * | 3/1962 | Hall et al. | 244/3.15 |
| 3,097,480 | A * | 7/1963 | Sohn | 244/3.22 |
| 3,862,732 | A * | 1/1975 | Wyatt et al. | 244/165 |
| 4,109,884 | A * | 8/1978 | Kranz et al. | 244/3.22 |
| 4,585,191 | A * | 4/1986 | Blount | 244/169 |
| 4,630,790 | A | 12/1986 | Williams, Jr. | |
| 4,641,802 | A | 2/1987 | Zalmon et al. | |
| 4,684,080 | A * | 8/1987 | Pinson | 244/3.22 |
| 4,763,857 | A | 8/1988 | Booth et al. | |
| 4,886,223 | A | 12/1989 | Gartner | |
| 7,150,235 | B1 | 12/2006 | Mikhail | |
| 8,084,726 | B2 * | 12/2011 | Hanlon et al. | 244/3.22 |
| 2008/0237391 | A1 | 10/2008 | Mock et al. | |
| 2010/0044495 | A1 | 2/2010 | Shpund et al. | |

* cited by examiner

*Primary Examiner* — Bernarr Gregory
(74) *Attorney, Agent, or Firm* — Daniel J. Long; Sand & Sebolt

(57) ABSTRACT

A system and method for guiding a projectile is presented. A nozzle system includes a boom assembly body that can be attached to a rear end of a projectile. A gas tank in the boom assembly contains pressurized gas. Fins are attached to the boom assembly body to guide the projectile. A valve lets a pulse of gas out of the gas tank. A nozzle expels the pulse of gas to control an angle of attack and lift of the projectile to guide the projectile to a target.

14 Claims, 4 Drawing Sheets

TAIL THRUSTER CONTROL FOR PROJECTILES

BACKGROUND OF THE INVENTION

1. Field of Invention

The current invention relates generally to apparatus, systems and methods for guiding projectiles. More particularly, the apparatus, systems and methods relate to a tail kit for guiding projectiles. Specifically, the apparatus, systems and methods provide for a tail kit with a thruster that controls the body angle of attack and the lift of a projectile when guiding the projectile.

2. Description of Related Art

Generally, precision mortar systems are implemented with a guidance kit that is added to the nose of the round. Lift is generated by controlling the body angle of attack. Lifting elements in front of the center of gravity (CG) are used to control the body angle of attack and also generate additive lift. These lifting elements can be thrusters, aerodynamic surfaces such as canards or wings, air diverters that collect air at the nose and push it out the side or thrusters. Generally, guidance systems added to the nose cannot truly be kits as they decouple the fuse from the safe and arm system. Since the fuse and arm system are now separated and part of the guidance package, the guidance system is an integral part of the round and cannot be removed in the field.

One aspect of mortar fire is its use as a suppression round. In this case, a rapid continuous and scattered impact of rounds causes the enemy to take cover. A guided round can actually slow the pace in this type of mission due to its programming requirements where an unguided round with inherent dispersion can be rapidly fired by dropping rounds in fast succession into the tube. Due to the desire of scattered impacts, a guided round in this case is wasted.

Other tail kit approaches have been developed for dropped weapons. A joint direct attack munition (JDAM) is an example that uses such an approach. This system uses large moveable tail surfaces aft of the CG to execute maneuvers. Because the tail has to push on the round in the opposite direction of the desired maneuver in order to hold angle of attack, the lifting surfaces actually subtract lift reducing total maneuver capability.

A tail kit for a mortar guidance solution must survive in a difficult environment. The mortar is launched by igniting a rapid bum propellant charge. This charge creates extreme pressures behind the round within the mortar tube that act to rapidly accelerate the round out of the tube. Any controlled mechanism must survive this environment and any interface between drive systems and wings create an opening through which hot gases and explosive residues can enter.

In order to use the currently fielded launch tubes and barrels, the volume behind the round cannot increase without degrading muzzle velocity and therefore range capability. With these constraints, the volume occupied by the tail must not grow in volume or length. Addition of flip out surfaces to enhance the tail area is complicated by the need to provide a motor or a mechanism driven by a shaft within the current tail volume. The volume required for motors and the mechanism further reduces the available lift generated by the tail. Analysis of the current tail area, disregarding the motor or mechanism, shows insufficient lift to steer the round. Adding flip out features to enhance tail control further aggravates the issues of constrained volumes. Given the extreme environments and constrained volumes, any kind of mechanically controlled rear lifting element is difficult if not impossible for an explosively launched round.

A need exists, therefore, for an improved apparatus, system and method of a more capable device for guiding projectiles.

SUMMARY OF THE INVENTION

The preferred embodiment of the invention includes a tail mounted guidance kit that avoids the need to modify the fuse, the key safety element of the system, by means of a tail-kit approach for guiding projectiles using thrusters to control body angle of attack and lift. It can be implemented on the current screw interface for the tail boom assembly. The screw off/screw on capability allows field selection of guided versus unguided rounds.

In another configuration of the preferred embodiment, a nozzle system includes a boom assembly body that can be attached to a rear end of a projectile. The boom assembly can include a threaded portion for screwing the boom assembly onto a treaded portion of the projectile. A gas tank in the boom assembly contains pressurized gas. The gas can be a pressurized cold gas. Fins are attached to the boom assembly body to guide the projectile. A valve lets a pulse of gas out of the gas tank. A nozzle expels the pulse of gas to control an angle of attack and lift of the projectile to guide the projectile to a target. A pipe may be used to transport the gas from the valve located near the gas tank to the nozzle located near the fins. The valve can be an electrically controlled solenoid valve or another type of valve.

In another configuration of the preferred embodiment, the fins are configured to cause the projectile to spin with a spin period. A control logic controls the valve so that pulses of gas are periodically released based, at least in part, on the spin period.

In one configuration, the nozzle is located near the fins to cause the projectile to travel in a direction of flight and the nozzle ejects the pulses of gas perpendicular to the direction of flight.

The nozzle system may operate with other devices to more accurately guide the projectile. For example, nozzle system can include flip-out surfaces for minimizing restoring forces and to maximize the lift of the projectile. The flip-out surfaces can be wing-shaped. The flip-out surfaces can pivot at a pivot points located near the CG of the projectile. Strakes can be snap-fitted onto and removably unsnapped from the front end of the projectile.

Other configurations of the preferred embodiment can include other useful features. For example, a pyrotechnic device of the nozzle system can be used to open the gas tank after the nozzle system is attached to the projectile after a lengthy storage period. The nozzle system can also include global positioning system (GPS) antennas to receive location data. Hardware control logic and or software can control the valve to generate the pulse of gas based, at least in part, on the location data.

Another configuration of the preferred embodiment is a method of guiding projectiles. The method begins by storing a gas in a chamber that is part of a tail assembly attached to a projectile. The tail assembly can include fins for rotating the projectile at a rotation speed. As previously mentioned, the gas may be a pressurized cold gas. The method releases bursts of gas out of the chamber to control an angle of attack of the projectile and to control a lift of the projectile to guide the projectile to a target. The burst of gas can be released perpendicular to a line of flight of the projectile. The method can release the burst of gas synchronized with the rotation speed.

Other configurations of the method can include attaching flip-out wings to the projectile to minimize restoring forces and to maximize lift of the projectile. The method can attach strakes to the projectile to enhance a lift and a maneuver acceleration capability of the projectile.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

The novel concept of the preferred embodiment of the invention includes a gas bottle, valve and thruster nozzle to control angle of attack of a projectile. A spin in the direction of arrow S is induced in the round and a valve fires a thruster phased with the round's spin to control the round's attitude in inertial space. This system is implemented in a field mountable tail kit assembly allowing selection of a guided versus unguided round.

Figure 1:
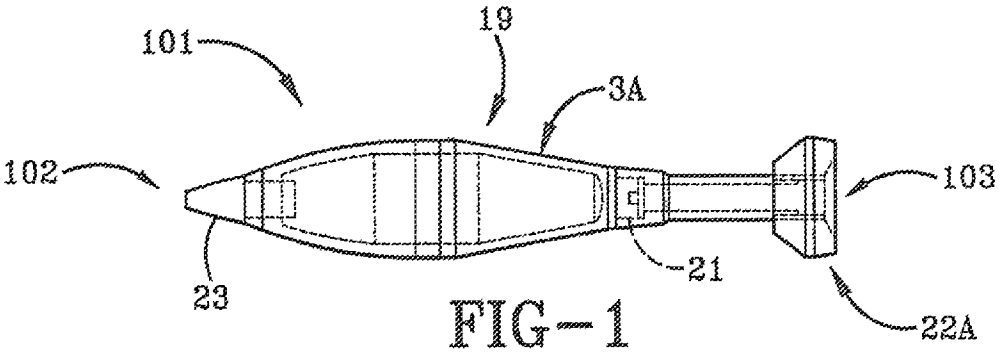
FIG-1 PRIOR ART
FIG. 1 illustrates a side view of a conventional projectile (round) with a tail fin assembly for guiding a projectile.

FIG. 1 illustrates a conventional round 101 (e.g., projectile, munition) that has not been modified by a thruster controller. In this figure, the base round 19 has a standard, fuse 23 and a screw off tail and boom assembly 22A with female threads attached to the munition body male threads 21. The munition 101 has a front end 102 and a back end 103.

Figure 2:
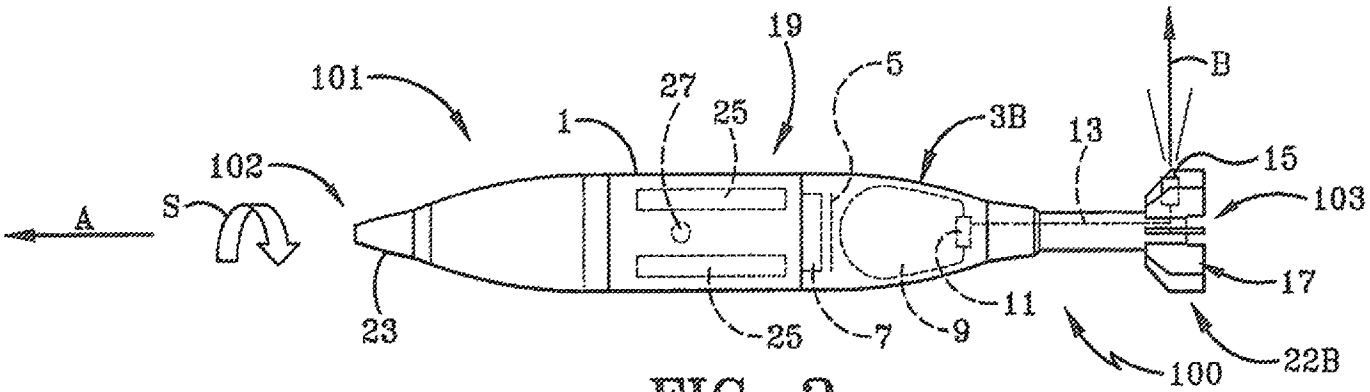
FIG. 2 illustrates a side view of the preferred embodiment of a thruster controller for guiding a projectile.

The round 101 can be converted to include the preferred embodiment of the thruster controller 100 that attaches to the male threads of the munition body 21 as shown in FIG. 2. A shroud 1 covers the existing boat-tail 3A of the base round 19 to improve the aerodynamics of the projectile. To accomplish this, a cylindrical section may be combined with a boat-tail 3B (FIG. 2) shaped identical to the base round boat-tail section 3A (FIG. 1). A tail boom and fin assembly 22B is integrally attached to the new boat-tail 3B. In one configuration of the preferred embodiment, the tail fin assembly 17 cannot be detached from the projectile 101 as is possible with prior art tail boom and fin assemblies.

The shroud can carry GPS antenna 25, this may be as few as one or perhaps four depending on coverage and anti-jam requirements. The body extension includes batteries 7 to power a GPS subsystem, processor, inertial sensors and controls for the thruster system on one or more electronics cards 5. Gas is stored under high pressure in tank 9. Valve assembly 11 can include both a pyrotechnic device to release the gas after long storage and an electrically controlled solenoid valve to control pulsed releases of gas for thrust generation. In other embodiments, a mechanical device that can react to a launch force that can exceed 10,000 G can be used to start the flow of gas rather than the pyrotechnic device. The gas is piped in pipe 13 to the rear 103 of the round 101 in order to optimize the movement generated by the gas thrust and minimize the negating force required to hold angle of attack. The mortar charges wrap approximately two-thirds of the way around the tail boom 22B allowing for a path for a pipe to the rear 103. As shown by arrow B, the nozzle system 15 is configured to direct the gas perpendicular to the tail boom 22B and the line of flight as shown by arrow A.

Alternatively, the nozzle system 15 can include the active solenoid valve 11 in order to reduce the turn on time of the thruster controller 100 by keeping the pipe system at full pressure. Another potential alternative would be to place the nozzle system 15 in the new body extension and closer to the center of gravity of the thruster controller 100. This location would require greater thrust force to cancel the restoring moment of the round 101 and would reduce the maneuver capability of the round 101 due to the higher thrust levels acting counter to the direction of maneuver.

In general, the timing of a thruster pulse controls the direction of the angle of attack in earth reference space. The duration of the pulse determines the amount of angle of attack. The timing and duration of the thrust impulse can be derived from a preloaded target GPS location and the current GPS location determined from the onboard GPS receiver and antennas. The guidance system is configured to determine required correction accelerations to impact the target and these acceleration commands can used to control the thruster. Other embodiments can include a nose mounted laser sensing seeker that can be used to guide the projectile to a laser designated spot on a target and, as understood by those of ordinary skill in the art, any common method can be used to communicate the line of sight angle to the tail mounted control system 100.

Figure 3:
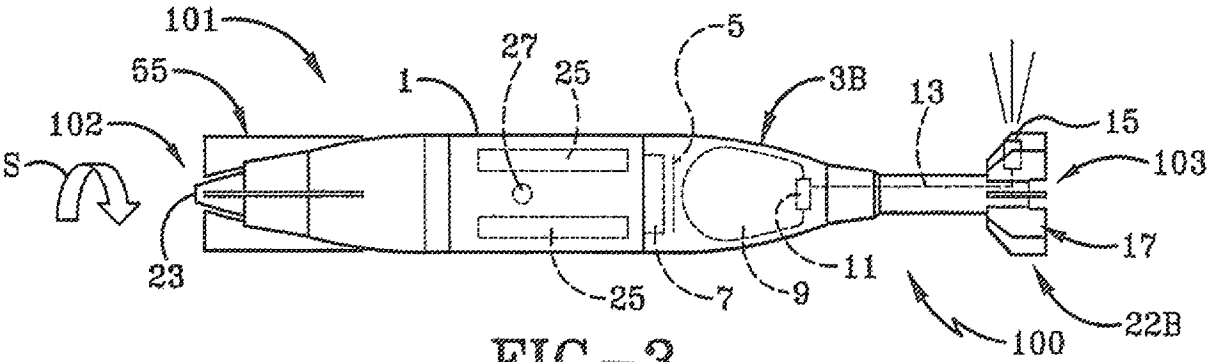
FIG. 3 illustrates a configuration of the preferred embodiment of the thruster controller that includes strakes.

Additional lifting features can be added to augment performance. FIG. 3 shows the addition of a strake assembly 55. This illustration shows four strakes but any number of strakes may be added to enhance system lift. This addition acts to destabilize the round requiring an enlargement of the tail 17 to increase stability. The addition of the strakes and enlarged tail will increase the net maneuver acceleration capability of the round without significantly changing the thruster requirements. As with the tail kit, the strake assembly 55 must be removable by the soldier. The strake assembly 55 can be fitted over the nose of the round 101 and snapped into place using existing extraction tool features on the round 101. The strake 55 assembly can be snapped off to allow the soldier to set the fuse for different modes of operation. Wind tunnel data for a system using canard controls suggest that fixed nose strakes can potentially increase by 1.5 meters/second$^2$ to a total lift on the order of 3 meters/ second$^2$.

In the configuration of FIG. 3, the lift generated by the tail is almost entirely canceled by the opposing lift required from the thruster to maintain angle of attack. The lift of the tail is designed to generate a restoring moment to stabilize the round. If the thrusters are off, the restoring moment forces the body angle of attack to zero. If the lifting surfaces of the tail were placed at half the distance from the CG, the lifting surfaces would have to increase by a factor of two to maintain the same restoring moment. The total lift would therefore increase by approximately half of the average thrust, an additional maneuver acceleration of 0.5*1.58=0.79 m/second$^2$ for a total maneuver of 2.37 meters/second$^2$.

Figure 4:
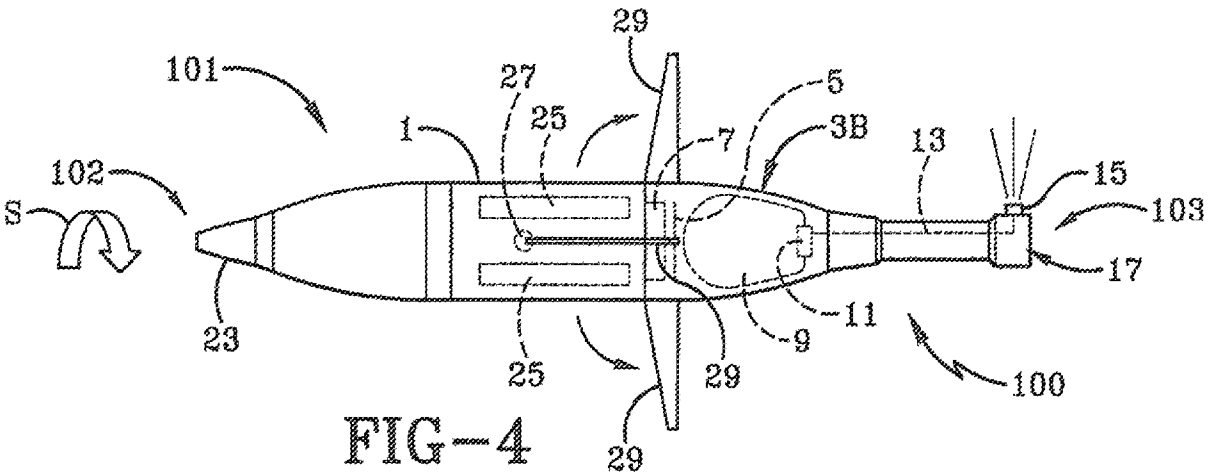
FIG. 4 illustrates a configuration of the preferred embodiment of the thruster controller that includes deployable wings to minimize restoring forces and to maximize lift of the projectile.

FIG. 4 is an example of such a configuration where the tail boom and fin assembly 22B has been replaced by fixed deploying wings 29 closer to the CG. There is an additional advantage in wing performance over the tail in that the wings are outside of the body shadow and the corresponding vortices created by the nose or other surfaces forward of the wings 29.

Figure 5:
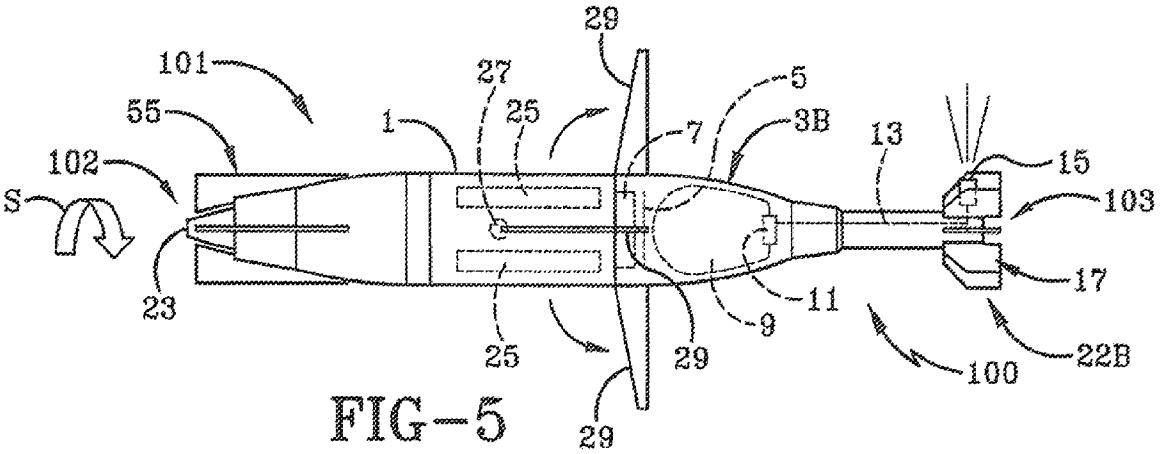
FIG. 5 illustrates a configuration of the preferred embodiment of the thruster controller that includes strakes and wings to maximize lift of the projectile.

FIG. 5 shows a final configuration that includes both the strakes 55 and the deployable wings 29. In this case, the wings 29 cannot provide sufficient restoring movement against the nose strake 55 so tail surfaces are included for stability. The configuration maximizes available lift in this tail kit configuration with augmentation from a snap on nose strake assembly.

Those skilled in the art will appreciate that the method and apparatus of the present invention makes use of a simple cold gas thruster approach to control maneuver lift. This mechanism is amenable to mounting in the environmentally challenging explosive environment of the tail. The tail kit does not modify the existing fuses, is cost competitive with low cost performance nose kits, and is performance competitive with more expensive nose kits systems using more complex controlled aerodynamic control surfaces that must be deployed after launch.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 6:
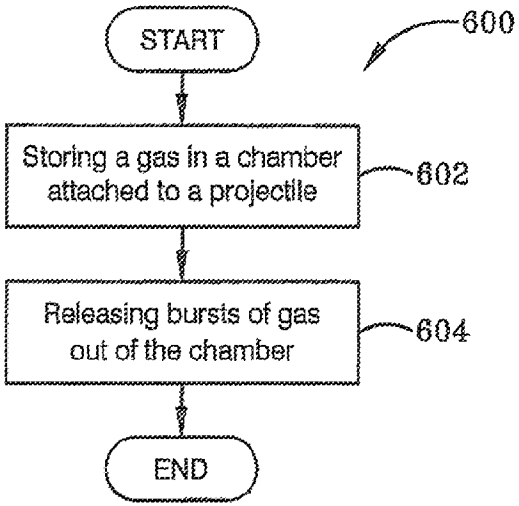
FIG. 6 illustrates the preferred embodiment configured as a method for guiding a projectile.
Figure 7:
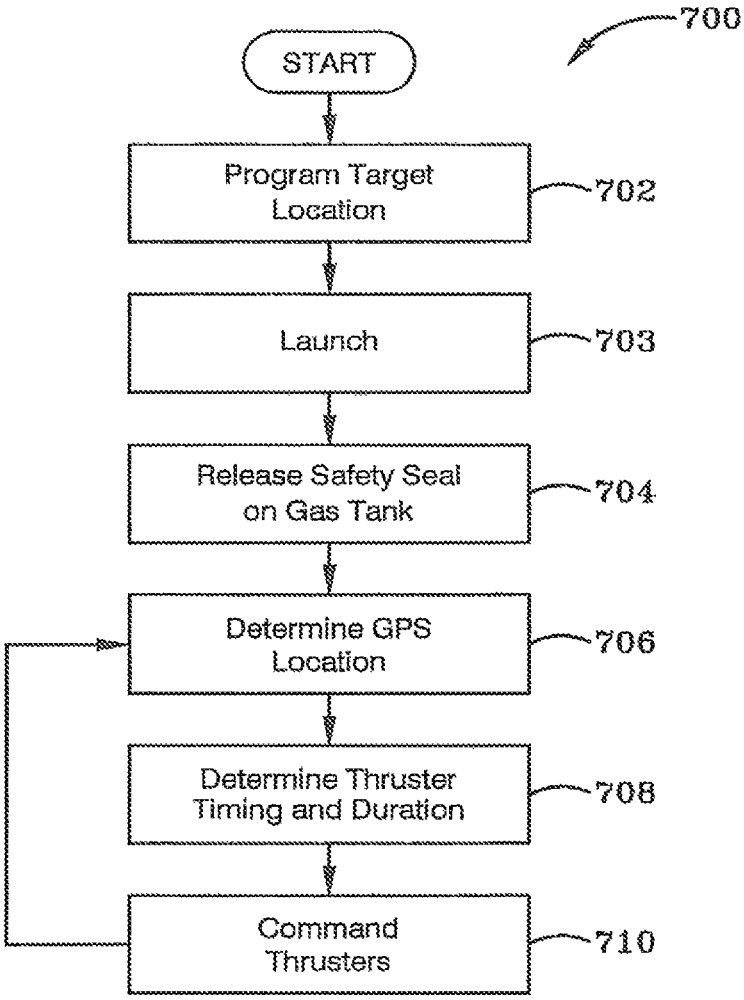
FIG. 7 illustrates the preferred embodiment configured as another method for guiding a projectile.

FIG. 6 illustrates a method 600 of guiding projectiles such as artillery and other types of rounds. The method 600 begins by storing a gas in a chamber that is attached to a projectile, at 602. The chamber can be part of a detachable fin assembly that can easy be attached to and detached from the projectile. A burst of gas is released out of the chamber, at 604, to control an angle of attack of the projectile and to control a lift of the projectile to guide the projectile to a target. The burst of gas can travel through a line from the tank to a nozzle near the fins where it is released perpendicular to a line of flight of the projectile. When the projectile is spinning as shown by arrow S in FIGS. 2-5, the burst of gas is synchronized with the speed of rotation.

Other embodiments of the method 600 of FIG. 6 can include attaching a fin assembly kit to the projectile that includes the chamber and fins for rotating the projectile at a rotation speed. In another configuration, the method 600 includes attaching flip-out wings to the projectile to minimize restoring forces and to maximize lift of the projectile. In addition to or instead of the flip-out wings, strakes can also be attached to the projectile to enhance a lift and a maneuver acceleration capability of the projectile.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A nozzle system comprising:

a boom assembly body configured to be attached to a rear end of a projectile that has front and rear ends;

a gas tank in the boom assembly for containing pressurized gas;

a plurality of fins attached to the boom assembly body configured to guide the projectile;

a valve configured to let a pulse of gas out of the gas tank;

a nozzle to expel the pulse of gas to control an angle of attack and to control attitude of the projectile to guide the projectile to a target.

2. The nozzle system of claim 1 further comprising:

a pipe to transport the gas from the valve located near the gas tank to the nozzle located near the plurality of fins.

3. The nozzle system of claim 1 wherein the plurality of fins is configured to cause the projectile to spin with a spin period and further comprising:

a control logic to control the valve so that pulses of gas are periodically released based, at least in part, on the spin period.

4. The nozzle system of claim 1 wherein the nozzle is located near the plurality of fins, wherein the projectile travels in a direction of flight, and wherein the nozzle is configured to eject pulses of gas perpendicular to the direction of flight.

5. The nozzle system of claim 1 further including flip-out surfaces configured to minimize restoring forces of the projectile.

6. The nozzle system of claim 1 wherein the flip-out surfaces are wing shaped.

7. The nozzle system of claim 6 further comprising:

pivot points located near a center of gravity of the projectile, wherein corresponding flip-out surfaces pivot at a corresponding pivot point near the center of gravity.

8. The nozzle system of claim 1 further comprising:

a strake configured to be snap fitted onto and removably unsnapped from the front end of the projectile.

9. The nozzle system of claim 1 wherein the valve is located near the fins and further comprising:

a pipe to transport gas in the gas tank to the valve, wherein the nozzle is located near the fins with the valve.

10. The nozzle system of claim 1 wherein the valve is an electrically controlled solenoid valve.

11. The nozzle system of claim 1 further comprising:

pyrotechnic device to open the gas tank after the nozzle system is attached to the projectile after storage.

12. The nozzle system of claim 1 further comprising:

global positioning system (GPS) antennas to receive location data;

guidance logic to control the valve to generate the pulse of gas based, at least in part, on the location data.

13. The nozzle system of claim 1 wherein the boom assembly body further comprises:

a threaded portion for screwing the boom assembly onto a treaded portion of the projectile.

14. The nozzle system of claim 1 wherein the gas tank is configured to store a pressurized gas that is a pressurized cold gas.

* * * * *